US008790582B2

(12) United States Patent
Müller et al.

(10) Patent No.: US 8,790,582 B2
(45) Date of Patent: Jul. 29, 2014

(54) HOUSING FOR AN EXHAUST GAS-TREATING DEVICE AND PROCESS FOR MANUFACTURING SAME

(75) Inventors: Bernd Müller, Spicheren (FR); Achim Blum, Saabrücken (DE); Oliver Poth, Holzerath (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 400 days.

(21) Appl. No.: 12/766,138

(22) Filed: Apr. 23, 2010

(65) Prior Publication Data

US 2010/0269495 A1 Oct. 28, 2010

(30) Foreign Application Priority Data

Apr. 24, 2009 (DE) ..... 10 2009 018 823

(51) Int. Cl.
*B01D 50/00* (2006.01)
*B21D 51/16* (2006.01)

(52) U.S. Cl.
USPC ..... 422/180; 29/890

(58) Field of Classification Search
USPC ..... 422/177, 180; 55/520–523; 428/116
See application file for complete search history.

(56) References Cited

U.S. PATENT DOCUMENTS

| | | | | |
|---|---|---|---|---|
| 3,989,471 | A * | 11/1976 | Nowak | 422/179 |
| 6,128,821 | A | 10/2000 | Grescher | |
| 6,334,981 | B1 * | 1/2002 | Wieres | 422/177 |
| 6,598,294 | B2 | 7/2003 | Yamaguchi et al. | |
| 2002/0071791 | A1 * | 6/2002 | Foster et al. | 422/179 |
| 2003/0154600 | A1 | 8/2003 | Umeda et al. | |
| 2007/0011874 | A1 * | 1/2007 | Myers | 29/890 |
| 2008/0028609 | A1 | 2/2008 | Umeda et al. | |
| 2008/0053080 | A1 * | 3/2008 | Faust et al. | 60/311 |
| 2009/0158720 | A1 | 6/2009 | Krause et al. | |

FOREIGN PATENT DOCUMENTS

| | | | |
|---|---|---|---|
| DE | 41 13 855 Al | | 8/1992 |
| DE | 197 11 789 Al | | 10/1998 |
| DE | 202005001616 | U1 | 5/2005 |
| DE | 103 58 504 Al | | 7/2005 |
| DE | 102007062662 | A1 | 6/2009 |
| EP | 1 243 768 | A2 | 9/2002 |
| EP | 1 980 728 Al | | 10/2008 |
| EP | 2075426 | A1 * | 7/2009 |
| WO | WO 02/20 208 Al | | 3/2002 |
| WO | WO 03/036057 | | 5/2003 |

* cited by examiner

*Primary Examiner* — Tom Duong
(74) *Attorney, Agent, or Firm* — McGlew and Tuttle, P.C.

(57) ABSTRACT

A housing (2) for an exhaust gas-treating device (1) of an exhaust system of an internal combustion engine includes a jacket (6) closed in the circumferential direction for mounting at least one exhaust gas-treating element (5. The jacket passes over at at least one axial end into a ring body (8, 9). The ring body (8, 9) is closed in the circumferential direction. The housing (2) can be connected to another component of the exhaust system. A simplified manufacture is achieved if the jacket (6) and the at least one ring body (8, 9) are manufactured from a single sheet steel billet (10) by rolling the sheet steel billet (10) in the circumferential direction and by connecting abutting edges (11) of the sheet steel billet (10). The jacket (6) and the at least one ring body (8, 9) differ from one another by different materials and/or different wall thicknesses (12, 13, 14).

20 Claims, 3 Drawing Sheets

HOUSING FOR AN EXHAUST GAS-TREATING DEVICE AND PROCESS FOR MANUFACTURING SAME

CROSS REFERENCE TO RELATED APPLICATIONS

This application claims the benefit of priority under 35 U.S.C. §119 of German Patent Application DE 10 2009 018 823.1 filed Apr. 24, 2009, the entire contents of which are incorporated herein by reference.

FIELD OF THE INVENTION

The present invention pertains to a housing for an exhaust gas-treating device of an exhaust system of an internal combustion engine. The present invention pertains, moreover, to a process for manufacturing such a housing.

BACKGROUND OF THE INVENTION

Housings of exhaust gas-treating device, for example, catalytic converters and particle filters, usually have a jacket closed in the circumferential direction for mounting at least one exhaust gas-treating element. This jacket may pass over at least at one axial end into a ring body, which is closed in the circumferential direction and is, for example, funnel-shaped, with which the housing can be connected to another component of the exhaust system. Furthermore, it is common practice to manufacture the jacket by rolling from a steel sheet billet, whereas the corresponding ring body is preferably manufactured by deep-drawing. The rolled jacket, which is welded at its abutting edges, is then axially connected to the ring body, namely, preferably by means of a weld seam. This conventional procedure for manufacturing such a housing is associated with a comparatively great effort.

SUMMARY OF THE INVENTION

The present invention pertains to the object of providing an improved embodiment for a housing of the type mentioned in the introduction and for the corresponding manufacturing process, which is characterized especially in that the housing can be manufactured at a comparatively low cost.

According to the invention, an exhaust gas-treating device housing is provided of an exhaust system of an internal combustion engine. The housing comprises a jacket, which is closed in the circumferential direction. The housing is for mounting at least one exhaust gas-treating element. A ring body is provided. The jacket passes over at one axial end into the ring body. The ring body is closed in a circumferential direction. The ring body is for connecting the housing to another component of the exhaust system The jacket and the ring body are manufactured from a single sheet steel billet by rolling the sheet steel billet in a circumferential direction and by connecting abutting edges of the sheet steel billet. The jacket and the ring body are at least one of formed of different materials and have different wall thicknesses.

The connecting of abutting edges may form a single butt joint extending in an axial direction over the jacket and over the ring body. The butt joint may advantageously extend only axially. The butt joint may comprise a welded connection or a beaded connection.

The ring body may comprise a funnel shape.

According to a further aspect of the invention, a process is provided for manufacturing an exhaust gas-treating device housing of an exhaust system of an internal combustion engine. The process includes providing a sheet steel billet which has at least two billet sections. The at least two billet sections have at least one of different material compositions and/or wall thickness. The sheet steel billet is shaped by rolling such that one of the billet sections forms a jacket of the housing and the at least one other of the billet sections forms at least one ring body arranged at an axial end of jacket. Abutting edges of the billet that have been shaped by rolling are connected to one another to form a butt joint.

The present invention is based on the general idea of manufacturing the jacket and at least one ring body by rolling by using a so-called tailored blank. Such a tailored blank is a sheet steel billet, which is characterized in that it has at least two areas consisting of different materials and/or having different wall thicknesses. Jackets and ring bodies of the housing can thus be shaped simultaneously during the rolling of the tailored blank, and the jacket and the ring body may be made of different materials and/or have different wall thicknesses. This procedure utilizes the discovery that, for example, the jacket is only subject to comparatively low stresses, whereas the at least one ring body is subject to much higher mechanical stresses. By reducing the wall thickness of the jacket compared to the wall thickness of the ring body, significant savings can be achieved here in terms of material, weight and costs. Furthermore, ferritic and austenitic sections can be obtained at the housing in an especially simple manner, which has a favorable effect especially on service life. For example, the jacket may be manufactured from an austenitic section of the sheet steel billet, whereas the ring body is manufactured from a ferritic section of the sheet steel billet, or vice versa. The use of a rolling method to manufacture the housing makes possible an especially simple adaptation to different rolling parameters for rolling the jacket, on the one hand, and for rolling the corresponding ring body, on the other hand. The corresponding housing can thus be manufactured at an especially low cost.

In an advantageous embodiment, the corresponding ring body may be designed as a funnel. An intake funnel and/or a discharge funnel of the housing can be made as a result integrally in one piece with the jacket and yet have different material properties or strength values. Adaptation to the different functions of the jacket and ring body or funnel can be optimized as a result. At the same time, comparatively low-cost manufacture is made possible by the procedure according to the present invention.

Other important features and advantages of the present invention appear from the subclaims, from the drawings and from the corresponding description of the figures on the basis of the drawings.

It is obvious that the above-mentioned features, which will also be explained below, can be used not only in the particular combination described, but in other combinations or alone as well, without going beyond the scope of the present invention.

Preferred exemplary embodiments of the present invention are shown in the drawings and will be explained in more detail in the following description, where identical reference numbers designate identical or similar or functionally identical components.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
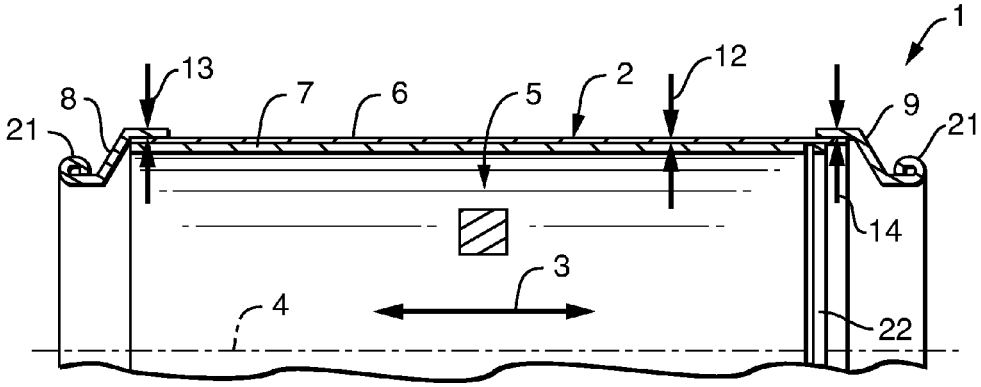
FIG. 1 is a greatly simplified longitudinal sectional view through a part of an exhaust gas-treating device of one of various embodiments.
Figure 2:
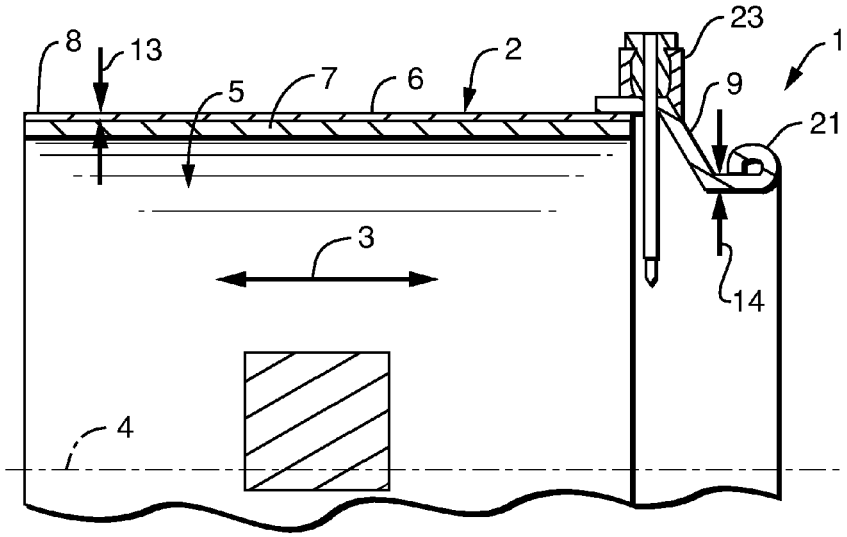
FIG. 2 is a greatly simplified longitudinal sectional view through a part of an exhaust gas-treating device of another of various embodiments.
Figure 3:
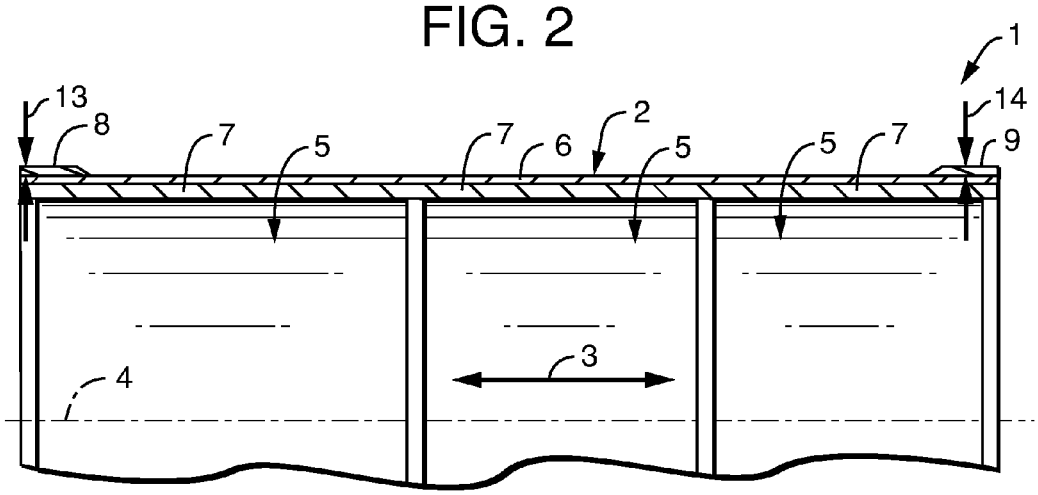
FIG. 3 is a greatly simplified longitudinal sectional view through a part of an exhaust gas-treating device of another of various embodiments.

Referring to the drawings in particular, corresponding to FIGS. 1 through 3, an exhaust gas-treating device 1 comprises a housing 2, which is closed in the circumferential direction. This circumferential direction pertains here to a longitudinal or axial direction 3, which extends in parallel to a central longitudinal axis 4 of housing 2. The exhaust gas-treating device 1 may be, for example, a catalytic converter or a particle filter. Correspondingly, at least one exhaust gas-treating element 5, which may be, for example, a catalytic converter element or a particle filter element, is arranged in housing 2. The exhaust gas-treating device 1 is intended for use in an exhaust system of an internal combustion engine, and the internal combustion engine may be preferably located in a motor vehicle.

Housing 2 comprises a jacket 6, which is closed in the circumferential direction and is designed to receive the at least one exhaust gas-treating element 5. Jacket 6 coaxially surrounds, for this purpose, the corresponding exhaust gas-treating element 5. The corresponding exhaust gas-treating element 5 may be positioned in jacket 6 by means of at least one mounting mat 7. Housing 2 comprises, furthermore, at least one ring body 8, 9. Two such ring bodies 8, 9 are provided in the examples being shown. The corresponding ring body 8, 9 is closed in the circumferential direction and is used to make it possible to connect housing 2 to another component of the exhaust system. Jacket 6 passes over into one of these ring bodies 8, 9 each at its axial ends.

Figure 4:
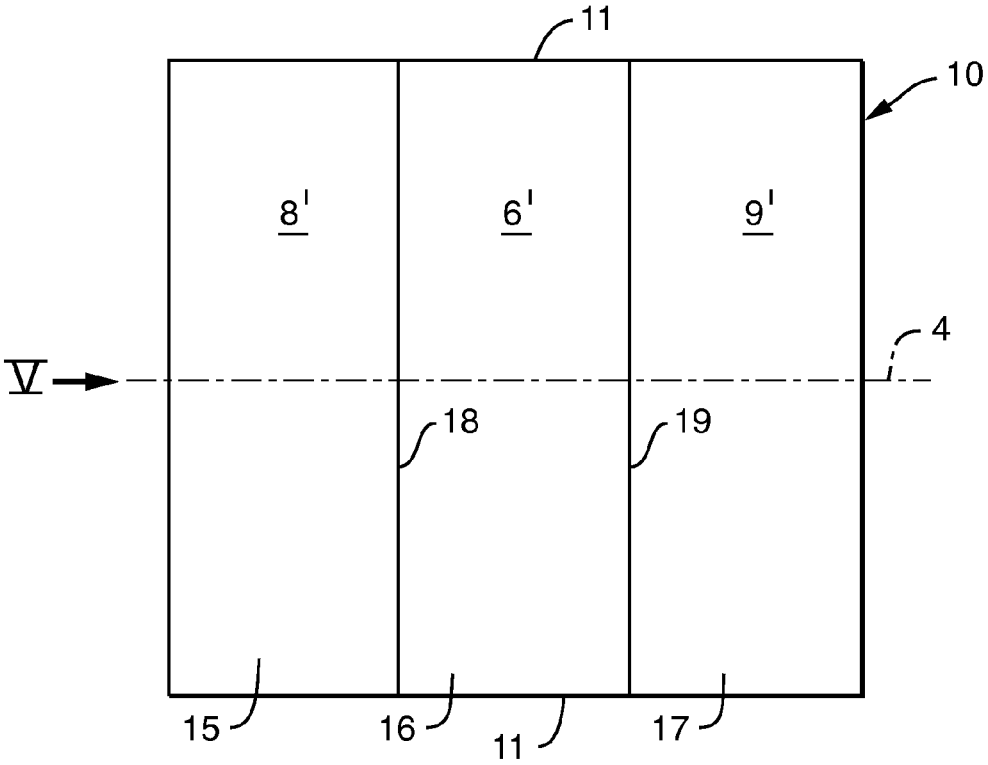
FIG. 4 is a top view of a sheet steel billet in an initial state.

Jacket 6 and the ring bodies 8, 9 are manufactured by rolling from a single sheet steel billet 10 shown in FIG. 4, and abutting edges 11 of the sheet steel billet 10 are connected to one another in the finished housing 2. Jacket 6 and at least one of the ring bodies 8, 9 differ from one another by different materials or by different wall thicknesses or by different materials and different wall thicknesses.

In the examples according to FIGS. 1 through 3, a wall thickness 12 of jacket 6 is markedly smaller than a wall thickness 13 of the ring body 8 shown on the left and smaller than a wall thickness 14 of the ring body 9 shown on the right. The wall thicknesses 13, 14 of the two ring bodies 8, 9 are equal in the examples according to FIGS. 1 and 3. Contrary to this, wall thickness 13 of the ring body 8 shown on the left is smaller in the embodiment shown in FIG. 2 than the wall thickness 14 of the ring body 9 shown on the right. In addition, jacket 6 and the corresponding ring body 8, 9 may also be manufactured from different materials. For example, jacket 6 may be manufactured from an austenitic steel sheet, whereas the ring bodies 8, 9 are manufactured from a ferritic steel sheet.

Both ring bodies 8, 9 are designed as funnels in the embodiment shown in FIG. 1. One ring body 8 or 9 now forms an intake funnel, whereas the other funnel 9, 8 now forms a discharge funnel. FIG. 2 shows an embodiment in which one ring body 8 is designed as a cylindrical sleeve, whereas the other ring body 9 is designed as a funnel. FIG. 3 shows an embodiment in which both ring bodies 8, 9 are designed as cylindrical sleeves.

A preferred process of manufacturing housing 6 will be described in more detail below on the basis of FIGS. 4 through 8.

FIG. 4 shows a top view of a steel sheet billet 10, by means of which housing 2 shall be manufactured. As can be recognized, the steel sheet billet 10 has a jacket area 6', which is intended to form the jacket 6, as well as at least one ring body area 8', 9', which is intended to form the respective ring body 8, 9. The steel sheet billet 10 is a so-called tailored blank and is characterized in that the areas 6', 8', 9' may have different designs. They differ, for example, by their wall thicknesses and/or by their materials. In the example, the steel sheet billet 10 has a smaller wall thickness in the jacket area 6' than in the ring body areas 8', 9'. These areas 6', 8', 9' of different wall thicknesses may be formed basically during the shaping of the steel sheet billet 10 by rolling. However, an embodiment in which sheets 15, 16, 17 of different wall thicknesses, which were shaped by rolling, are welded together by weld seams 18, 19 at their lateral longitudinal edges in order to produce the corresponding sheet steel billet 10, is preferred. The individual partial sheets 15, 16, 17 are supplied industrially in the form of sheet webs on corresponding rolls or coils. The sheet webs are rolled off from these coils and connected to one another along the weld seams 18, 19, as a result of which a web is formed, which can likewise be rolled up on a roll. A sheet web can then be rolled off from the latter roll and separated into the individual sheet steel billets 10, as a result of which the abutting edges 11 are formed.

Figure 5:
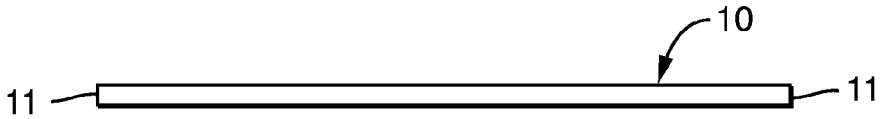
FIG. 5 is a side view of the sheet steel billet corresponding to a direction of view in FIG. 4 during one of different phases of a manufacturing process.
Figure 6:
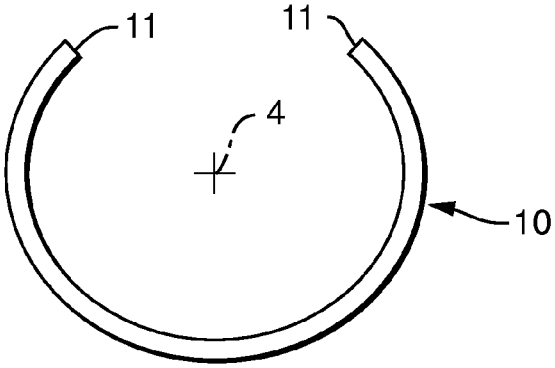
FIG. 6 is a side view of the sheet steel billet corresponding to a direction of view V in FIG. 4 during another of different phases of a manufacturing process.

The sheet steel billet 10 extends in one plane in the initial state shown in FIGS. 4 and 5. Corresponding to FIGS. 6 and 7, the sheet steel billet 10 is shaped by means of a roll, I. e., shaped by rolling, the shaping by rolling being performed in relation to the central longitudinal axis 4 of the housing 2 to be manufactured. Jacket section 6' correspondingly forms the jacket 6 during the shaping by rolling, whereas the ring body sections 8', 9' form the corresponding ring body 8, 9 during the shaping by rolling.

Figure 7:
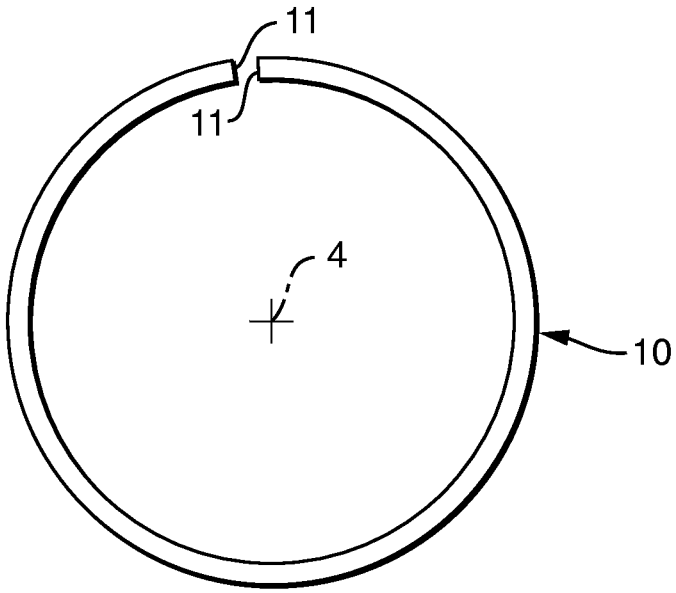
FIG. 7 is a side view of the sheet steel billet corresponding to a direction of view in FIG. 4 during another of different phases of a manufacturing process.
Figure 8:
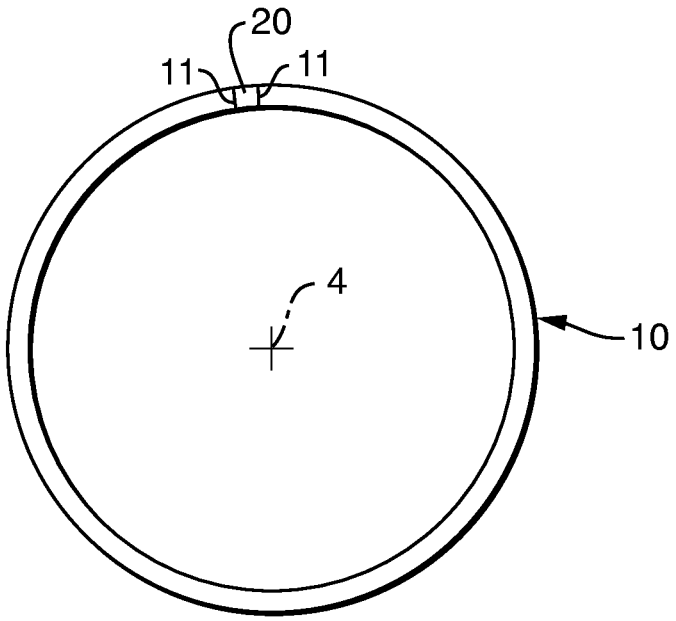
FIG. 8 is a side view of the sheet steel billet corresponding to a direction of view in FIG. 4 during another of different phases of a manufacturing process.

The state shown in FIG. 7, in which the abutting edges 11 are located opposite each other, is presented after the shaping by rolling. The abutting edges 11 of the roll-shaped sheet steel billet 10 are connected to one another corresponding to FIG. 8. A corresponding connection is designated by 20 in FIG. 8. This connection 20 is preferably a weld seam. As an alternative, it is also possible to design the connection 20 as a beaded connection. The blank of the sheet steel billet 10 is preferably selected to be such that a straight butt joint 20 is formed after the roll shaping of the sheet steel billet 10. Furthermore, the rolling process is preferably carried out such that this butt joint 20 extends only axially, I. e., in parallel to the central longitudinal axis 4.

Housing 2 has, as a result, a single butt joint 20, which extends in the axial direction over the entire housing 2 or over the jacket 6 and over the corresponding ring body 8, 9 made integrally in one piece therewith.

Corresponding to a preferred embodiment, jacket 6 and the ring bodies 8, 9 are subjected to final shaping only after the butt joint 20 has been prepared. This final shaping contains, for example, the forming of at least one of the ring bodies 8, 9 into a funnel. The final shaping may also comprise, in addition or as an alternative, the formation of a beading 21 integrally in one piece, as this is shown in FIGS. 1 and 2. Beading 21 extends circularly in the circumferential direction. In addition or as an alternative, provisions may be made for inserting the at least one exhaust gas-treating element 5 together with the corresponding mounting mat 7 into housing 2 or into jacket 6, the so-called canning, prior to the final shaping of jacket 6 or of the corresponding ring body 8, 9. A desired prestress is brought about in the corresponding bearing mat 7 only by the final shaping of the jacket 6 in order to properly fix the corresponding exhaust gas-treating element 5 in jacket 6 or in housing 2. It is likewise possible corresponding to FIG. 1, prior to the insertion of the corresponding exhaust gas-treating element 5, to incorporate, especially weld in, an axial end stop 22 in housing 2. This end stop 22 supports the corresponding exhaust gas-treating element 5 in the axial direction 3. During the final shaping of the ring bodies 8, 9, dimensions of the ring bodies 8, 9 can be adapted to connection elements, to which they are to be connected when the exhaust gas-treating device 1 is installed in an exhaust system. Due to this subsequent final shaping, it is especially simple to adapt the housing 2 to comparatively broad shape tolerances of the exhaust gas-treating elements 5, which may be, for example, ceramic monoliths.

Provisions may be made corresponding to FIG. 2 after the final shaping for attaching a probe 23 to the housing 2, here to the ring body 9 on the right.

In all the embodiments shown here, the sheet steel billet 10 is shaped such that or the shaping by rolling of the sheet steel billet 10 is carried out such that the corresponding greater wall thickness 13, 14 is applied to the housing 2 towards the outside only. A constant internal cross section is obtained hereby for the interior of housing 2 for the section of housing 2, which said section receives the corresponding exhaust gas-treating element 5, which facilitates the insertion of the corresponding exhaust gas-treating element 5. In particular, the corresponding exhaust gas-treating element 5 can extend in the axial direction up to at least one of the ring bodies 8, so that, as is indicated in FIGS. 1 through 3, an axial overlap may be obtained between the corresponding ring body 8, 9 and the corresponding exhaust gas-treating element 5.

While specific embodiments of the invention have been described in detail to illustrate the application of the principles of the invention, it will be understood that the invention may be embodied otherwise without departing from such principles.

What is claimed is:

1. An exhaust gas-treating device housing of an exhaust system of an internal combustion engine, the housing comprising:

a jacket, which is closed in the circumferential direction, for mounting at least one exhaust gas-treating element;

a ring body, said jacket passing over at one axial end into said ring body, said ring body being closed in a circumferential direction, said ring body for connecting said housing to another component of the exhaust system, said jacket and said ring body being manufactured from a single sheet steel billet by rolling the sheet steel billet in a circumferential direction and by connecting abutting edges of the sheet steel billet, said jacket and said ring body being at least one of formed of different materials and having different wall thicknesses to have said ring body be stronger than said jacket, different portions of said single sheet steel billet form said jacket and said ring body, said different portions of said single sheet steel billet being connected together at their lateral longitudinal edges.

2. A housing in accordance with claim 1, further comprising a single butt joint having a longitudinal axis extending in an axial direction over the jacket and over said ring body.

3. A housing in accordance with claim 2, wherein said butt joint extends only axially.

4. A housing in accordance with claim 2, wherein said butt joint comprises a welded connection or a beaded connection.

5. A housing in accordance with claim 2, wherein:

said butt joint connects said abutting edges of said sheet steel billet.

6. A housing in accordance with claim 1, wherein the ring body comprises a funnel shape.

7. A housing in accordance with claim 1, wherein:

one of said material of said ring body and said thickness of said material of said ring body is different than a corresponding one of said material and thickness of said jacket to cause said ring body to withstand higher mechanical stresses than said jacket.

8. A housing in accordance with claim 7, wherein:

a first section of said sheet steel billet forms said ring body, said first section being formed of ferritic steel;

a second section of said sheet steel billet forms said jacket, said second section being formed of austenitic steel.

9. An exhaust gas-treating device housing of an exhaust system of an internal combustion engine, the housing comprising:

a jacket closed in a circumferential direction, said jacket for mounting at least one exhaust gas-treating element;

a ring body closed in the circumferential direction, said ring body for connecting said housing to another component of the exhaust system, said jacket and said ring body being formed from a single sheet steel billet at least one of formed of different materials and having different wall thicknesses, different portions of said single sheet steel billet form said jacket and said ring body, said different portions of said single sheet steel billet being connected together at their lateral longitudinal edges, the single sheet steel billet being rolled in the circumferential direction and edges of the single sheet steel billet being connected as abutting edges of the single sheet steel billet to provide a closed form in the circumferential direction, said jacket and said ring body being at least one of formed of different materials and having different wall thicknesses with said jacket passing over at one axial end into said ring body based on the single sheet steel billet being one of formed of different materials and having different wall thicknesses, said materials and said thicknesses of said single sheet billet forming said ring body to withstand higher mechanical stresses than said jacket.

10. A housing in accordance with claim 9, further comprising a single butt joint having a longitudinal axis extending in an axial direction over the jacket and over said ring body.

11. A housing in accordance with claim 10, wherein said butt joint comprises a welded connection or a beaded connection.

12. A housing in accordance with claim 10, wherein the jacket and/or the at least one ring body are subjected to final shaping after the butt joint has been prepared.

13. A housing in accordance with claim 12, wherein the at least one ring body is provided with a beading extending in the circumferential direction after the butt joint has been prepared.

14. A housing in accordance with claim 10, wherein:

said butt joint connects said abutting edges of said sheet steel billet.

15. A housing in accordance with claim 9, wherein the ring body comprises a funnel shape.

16. A housing in accordance with claim 9, wherein at least one exhaust gas-treating element is inserted into the housing prior to a final shaping of the jacket and/or prior to a final shaping of the at least one ring body.

17. A housing in accordance with claim 9, wherein the shaping of the sheet steel billet by rolling with billet sections of different wall thicknesses is carried out such that a greater wall thickness of the housing is provided only towards an outside with respect to an axial extent of the housing.

18. A housing in accordance with claim 9, wherein:

one of said material of said ring body and said thickness of said material of said ring body is different than a corresponding one of said material and thickness of said jacket to cause said ring body to withstand higher mechanical stresses than said jacket.

19. A housing in accordance with claim 18, wherein:

a first section of said sheet steel billet forms said ring body, said first section being formed of ferritic steel;

a second section of said sheet steel billet forms said jacket, said second section being formed of austenitic steel.

20. A housing in accordance with claim 9, wherein:

said different portions of said single sheet steel billet are connected by weld seams at their lateral longitudinal edges.

* * * * *